US006425589B1

(12) United States Patent
Wu

(10) Patent No.: US 6,425,589 B1
(45) Date of Patent: Jul. 30, 2002

(54) GOLF BAG FUNCTIONING AS A GOLF CART AND A FOOT STAND

(76) Inventor: Kuo-Chen Wu, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 09/975,966

(22) Filed: Oct. 15, 2001

(51) Int. Cl.[7] ..... B62B 1/12

(52) U.S. Cl. ..... 280/30; 206/315.7; 150/159; 280/652; 280/47.26; 280/DIG. 6

(58) Field of Search ..... 280/30, 645, 651, 280/652, 655, 47.18, 47.24, 47.26, DIG. 6; 150/159; 206/315.3, 315.5, 315.7

(56) References Cited

U.S. PATENT DOCUMENTS 2,760,782 A * 8/1956 Hartzell ..... 280/DIG. 6
3,150,881 A * 9/1964 Van Skyock ..... 280/DIG. 6
3,489,426 A * 1/1970 Bond ..... 280/DIG. 6
4,735,425 A * 4/1988 Hoff ..... 280/47.24
5,267,750 A * 12/1993 Thompson ..... 280/DIG. 6
5,454,576 A * 10/1995 Pitkanen ..... 280/47.26
5,470,095 A * 11/1995 Bridges ..... 280/655
5,632,496 A * 5/1997 Nelson ..... 280/DIG. 6
5,967,543 A * 10/1999 Taylor ..... 280/47.26

* cited by examiner

*Primary Examiner*—Michael Mar
(74) *Attorney, Agent, or Firm*—Troxell Law Office PLLC

(57) ABSTRACT

A golf bag functioning as a golf cart and a foot stand has a pair of pivot joint elements disposed respectively at upper and lower ends of the golf bag; a pair of primary supports and a pair of secondary supports are respectively and pivotally disposed on the pivot joint elements; the distal end area of the primary support is bent to a certain angle to superpose the distal free ends of the primary and the secondary supports when the primary and the secondary supports are pulled outward; a pair of dismountable wheels are disposed on the distal ends of the primary and the secondary supports; a pull rod is disposed in a dismounted way on the upper and the lower pivot joint elements; thus, the wheels and the pull rod easily associate with the golf bag and make the golf bag move forward by means of the wheels.

3 Claims, 6 Drawing Sheets

GOLF BAG FUNCTIONING AS A GOLF CART AND A FOOT STAND

BACKGROUND OF THE INVENTION

1) Field of the Invention

The present invention relates to a golf bag functioning as a golf cart and a foot stand, more specifically, a golf bag using the retainment between a pair of retainers of a pair of retaining elements on a pair of wheels and a pair of insert holes on a primary and a pair of secondary supports of a golf bag, as well as the insertion between a pair of fix buttons of a pair of engagement elements on the golf bag and a pair of insert holes of a pull rod to enable the said wheels and the pull rod to easily engage with the golf bag, thereby, to pull the pull rod for moving the golf bag forward.

2) Description of the Prior Art

Accordingly, the traditional golf bag usually has a shoulder strap disposed on the back side of the said golf bag to enable the user to carry the golf bag on the shoulder and move the golf bag along for golfing. However, generally, the golf course occupies quite a big area and the golf clubs placed in the golf bag are very heavy, therefore, the user easily becomes tired after shouldering the golf bag for a long time. There is a foot stand bag with a foot stand disposed on the golf bag and capable of standing the golf bag temporarily on the fairway. However, the foot stand bag can't be dragged to move but is placed on a fixed point on the fairway; for moving, the user still needs to carry the golf bag on the shoulder and still gets tired due to carrying for a long time.

There is a golf cart permitting the user to install the golf bag on the golf cart and to move the golf bag forward by pulling the golf cart so as to solve the mentioned shortcoming of getting tired from shouldering the golf bag for too long. However, the golf cart is an independent unit separated from the golf bag, therefore, the user has to carry both the golf bag and the golf cart to the golf course and that is very inconvenient to the user.

BACKGROUND OF THE INVENTION

Therefore, the primary objective of the present invention is to provide a golf bag functioning as a golf cart and a foot stand; upper and lower pivot joint elements are symmetrically disposed at upper and lower ends on one lateral plane of the golf bag; wherein, a pair of primary supports is pivotally disposed on the upper pivot joint element and a pair of secondary supports is pivotally disposed on the lower pivot joint element; the free end near the distal end area of the primary support is bent to a certain angle to make the distal end of the primary support downwardly superpose the distal end of the secondary supports when the primary and the secondary supports are opened outward; a pair of wheels are disposed at the distal ends of the primary and the secondary supports; a pair of hollow retaining elements are pivotally and respectively disposed on the inner sides of the wheels corresponding to the distal end positions of the primary and the secondary supports can insert into the receiving spaces of the retaining elements; through the retainment between a pair of retainers disposed on the upper and the lower planes of the retaining elements and a pair of insert holes disposed on the primary and the secondary supports, the wheels and the distal ends of the primary and the secondary supports are engaged together.

Another objective of the present invention is to dispose a pull rod on the upper and lower pivot joint elements; the pull rod sequentially penetrates through a pair of engagement elements disposed respectively on the upper and the lower pivot joint elements; a pair of fix buttons on one side of the engagement elements retain onto the insert holes disposed on the pull rod, thereby the pull rod and the golf bag are associated with each other; therefore, through the retainment between the retainers of the retaining elements on the wheels and the insert holes of the primary and the secondary supports of a golf bag, as well as the insertion between the fix buttons of the engagement elements on the golf bag and the insert holes of the pull rod, the wheels and the pull rod are easily engaged with the golf bag for pulling the pull rod to make the golf bag move forward.

To enable a further understanding of the objectives, the configurations as well as the features and the functions of the structural device of the present invention, the brief description of the drawings below is followed by the detailed description of the preferred embodiment.

DETAILED DESCRIPTION OF THE PREFERRED EMBODIMENTS

Figure 1:
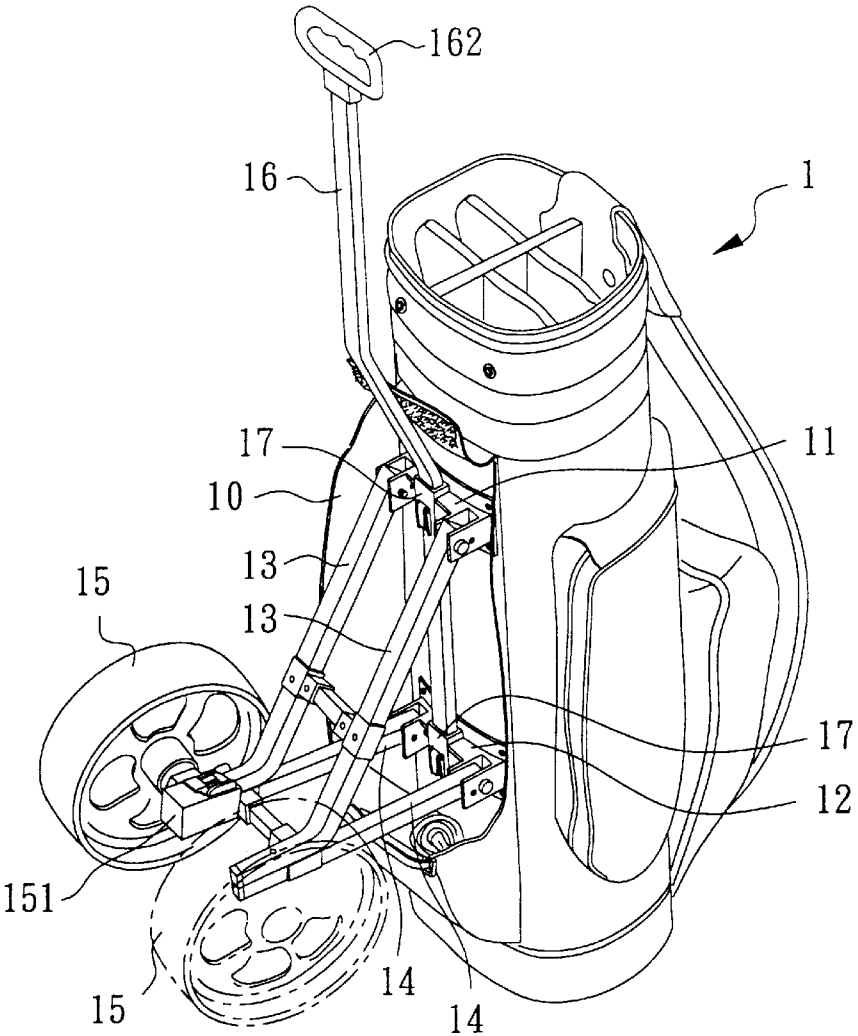
FIG. 1 is a pictorial and external view drawing of the present invention.
Figure 2:
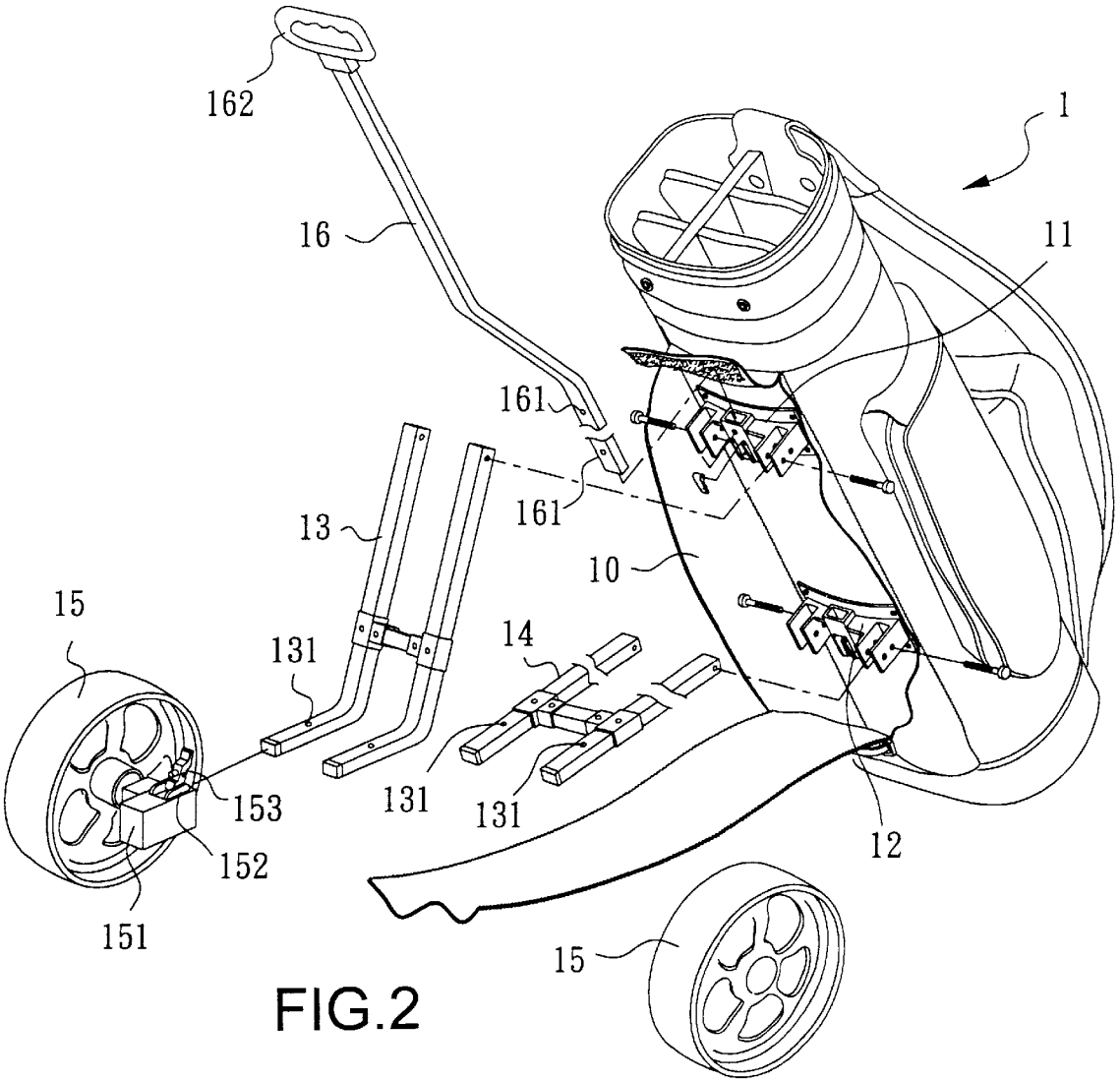
FIG. 2 is a pictorial and exploded drawing of the present invention.
Figure 3:
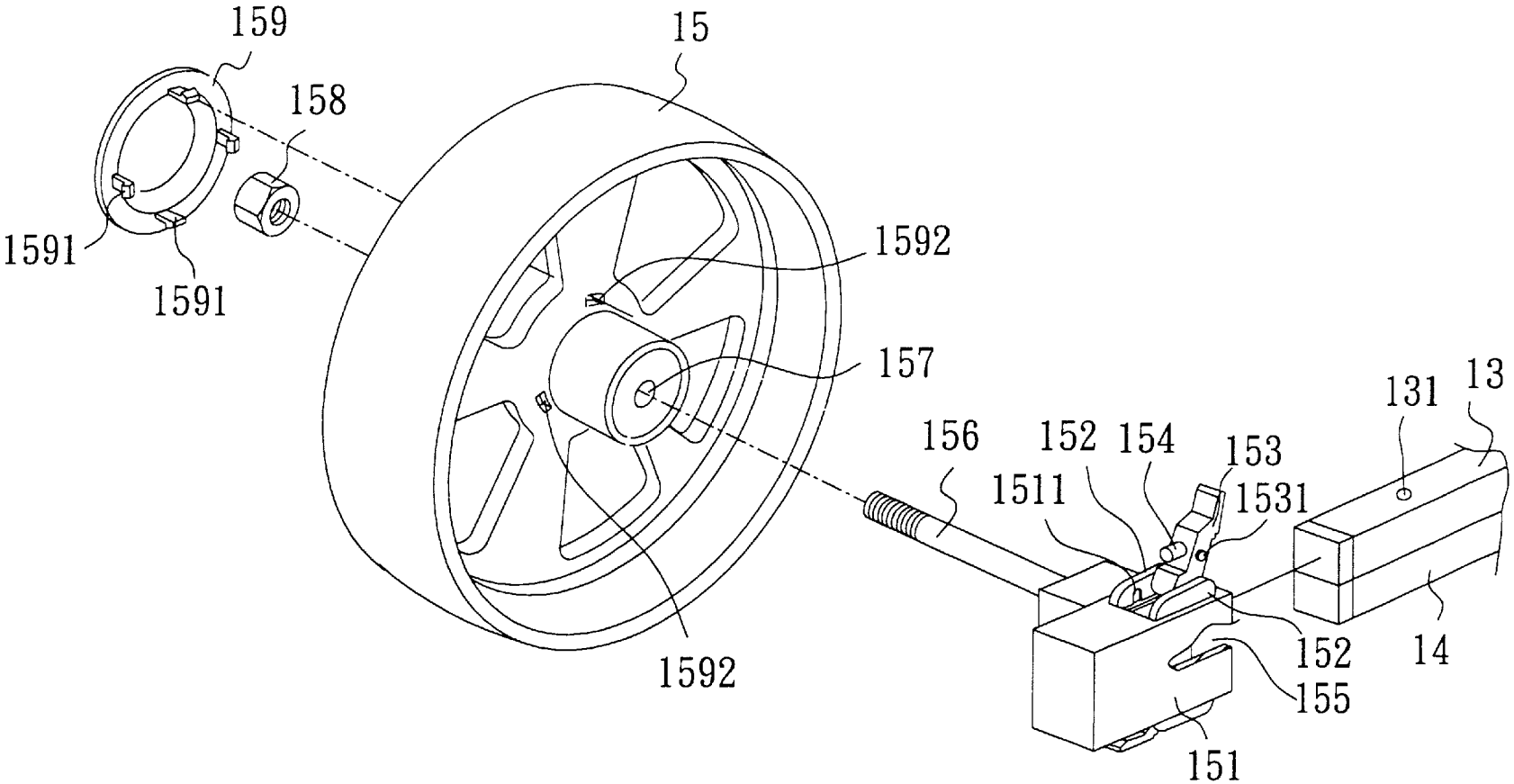
FIG. 3 is a pictorial and exploded drawing of a wheel of the present invention.
Figure 4:
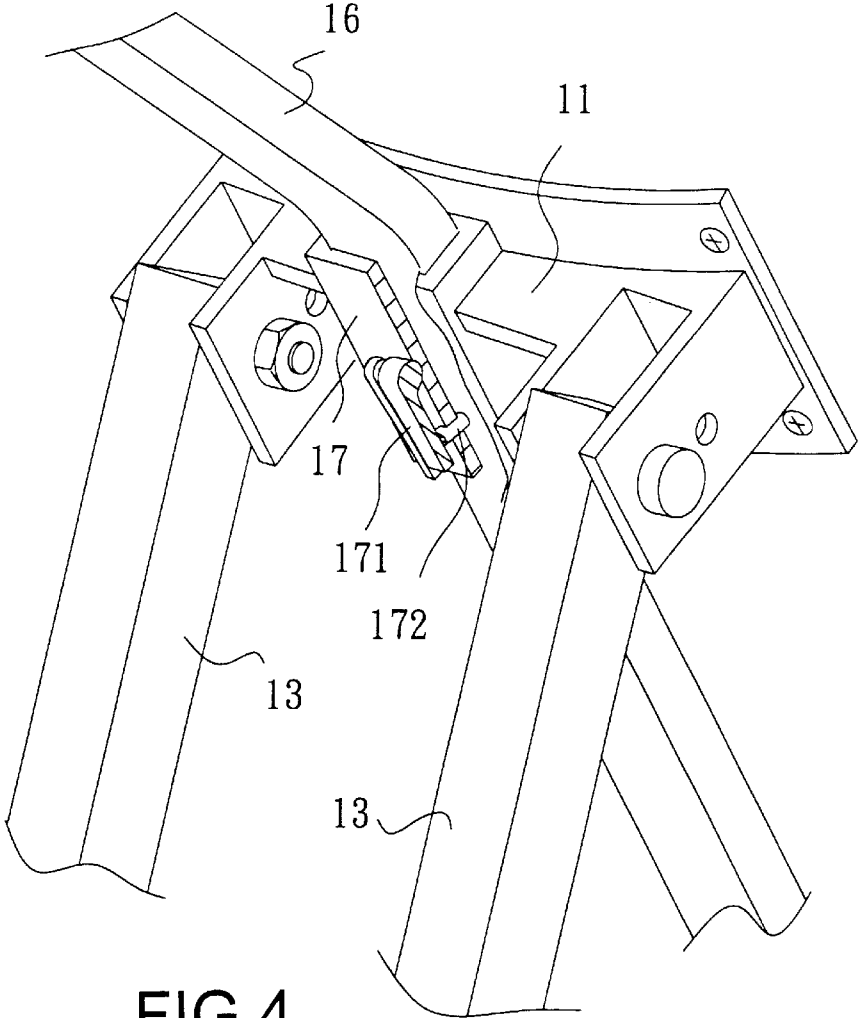
FIG. 4 is a partially enlarged and schematic drawing of the present invention.
Figure 5:
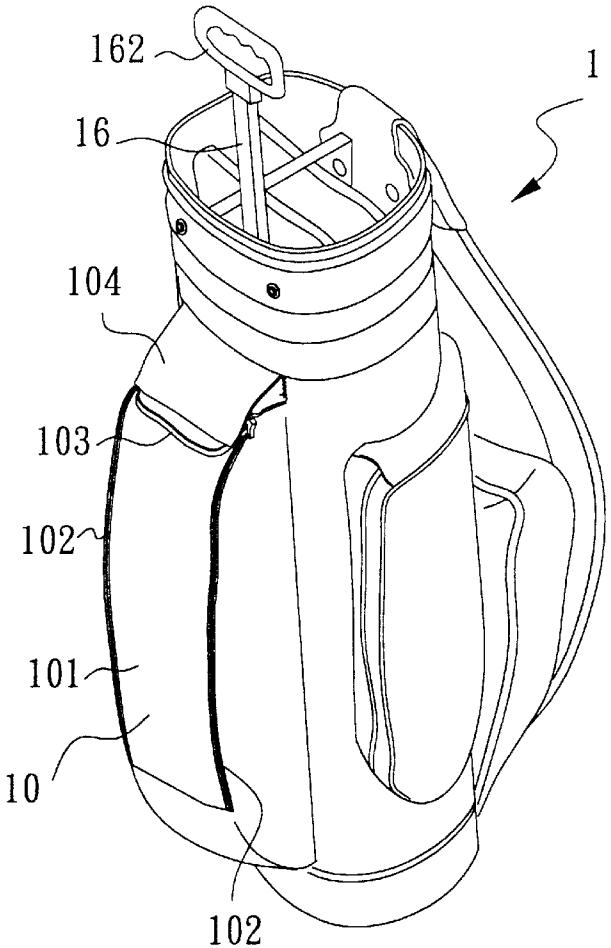
FIG. 5 is the first schematic drawing of the present invention in application state.

The present invention relates to a golf bag functioning as a golf cart and a foot stand, referring to FIGS. 1 and 2, mainly comprising a golf bag (1) with a pocket body (10) disposed on one lateral side of the golf bag (1), as shown in FIG. 5; inside the said pocket body (10), the upper and the lower ends of a plane on the golf bag (1) are respectively and symmetrically disposed with an upper and a lower pivot joint elements (11, 12), wherein, a pair of primary supports (13) is pivotally disposed on the upper pivot joint element (11) and a pair of secondary supports (14) is pivotally disposed on the lower pivot joint element (12); the free end near the distal end area of the primary support (13) is bent to a certain angle to make the distal end at the free end of the primary support (13) superpose the distal free end of the secondary support (14) when the primary and the secondary supports (13, 14) are pulled outward; referring to FIGS. 1, 2 and 3, a pair of insert holes (131) spaced and arranged in an equal distance are disposed the top and the bottom of the distal free ends of the primary and the secondary supports (13, 14); a pair of wheels (15) are disposed at the distal free ends of the primary and the secondary supports (13, 14); a pair of hollow retaining elements (151) are pivotally disposed on the inner sides of the wheels (15) corresponding to the distal end positions of the primary and the secondary supports (13, 14); an opening (155) is disposed on one side of the retaining element (151) corresponding to the primary and the secondary supports (13, 14) permitting the distal ends of the primary and the secondary supports (13, 14) to insert into the receiving space of the retaining elements (151); an open slot is disposed on the upper and lower sides of the retaining element (151) corresponding to the positions of the insert holes (131); a pair of flanges (152) is disposed upward at the connecting area between two sides of the open slot and the retaining element (151); a retainer (153) is pivotally disposed between the flanges (152); a cylindrical post (154) fitting the insert hole (131) is disposed on the retainer (153); when the distal ends of the primary and the secondary supports (13, 14) are inserted in the receiving spaces of the retaining elements (151), the posts (154) on the retainers (153) of the retaining elements (151) retain into the insert holes (131) of the primary and the secondary supports (13, 14), thereby making the wheels (15) as well as the primary and the secondary supports (13, 14) engage together; referring to FIGS. 1, 2 and 4, a pull rod (16) is disposed on the upper and lower pivot joint elements (11, 12); the pull rod (16) sequentially penetrates through a pair of hollow engagement elements (17) disposed on the upper and the lower pivot joint elements (11, 12); a pair of fix buttons (171) on one side of the engagement elements (17) retain into the insert holes (161) disposed on the pull rod (16), thereby the pull rod (16) and the golf bag (1) are connected with each other.

According to the present invention, referring to FIG. 3, a bolt (156) extending outward is disposed at the joint area between the retaining element (151) and the wheel (15); the bolt (156) penetrates a through hole (157) at the center of the wheel (15) and screws with a nut (158) to pivotally join the retaining element (151) and the wheel (15); the outer side of the wheel (15) is disposed with a ring-shaped felly cover (159); a plurality of retaining tenons (1591) are disposed on one side of the felly cover (159) corresponding to the wheel (15); a plurality of retaining holes (1592) are disposed on the wheel (15); the retaining tenons (1591) retaining into the retaining holes (1592) enables the felly cover (159) to engage the outer side of the wheel (15).

According to the present invention, referring to FIG. 3, a retaining slot (1511) is formed on the inner sides of the flanges (152) of the retaining element (151); a pair of convex bodies (1531) are respectively disposed on the two sides of the retainer (153); when the posts (154) on the retainers (153) retain into the insert holes (131) on the primary and the secondary supports (13, 14), the convex bodies (1531) simultaneously retain onto the retaining slots (1511) to make the retainers (153) more firmly retain to the primary and the secondary supports (13, 14).

According to the present invention, referring to FIGS. 2 and 4, the engagement elements (17) are disposed adjacent to the center areas on the upper and the lower pivot elements (11, 12); wherein, a pair of openings are disposed respectively on the top and the bottom sides of the engagement element (17) of said upper pivot joint element (11) to allow the pull rod (16) to sequentially insert downward onto the engagement elements (17) of the upper and the lower pivot joint elements (11, 12); the fix button (171) is pivotally disposed on one side of the engagement element (17); a cylindrical post (172) is disposed at the distal end of the free end of the fix button (171) facing the engagement element (17); the engagement element (17) is disposed with a through hole fitting the post (172); when the pull rod (16) inserts onto the said engagement element (17), the post (172) on the fix button (171) of the engagement element (17) penetrates the through hole of the engagement element (17) and retains into the insert hole (161) of the pull rod (16), thereby joining the pull rod (16) and the golf bag (1) together.

According to present invention, referring to FIGS. 1 and 2, a ring-shaped grip portion (162) is disposed at the upper end of the pull rod (16) permitting the user to hold the grip portion (162) for pulling the golf bag (1); adjacent to the center area of the pull rod (16), there is an angle bent outward to keep the upper end of the pull rod (16) away from the golf clubs inside the golf bag (1) and prevent the bumping among the golf clubs; the length of the pull rod (16) is the same as that of a regular golf club.

Figure 6:
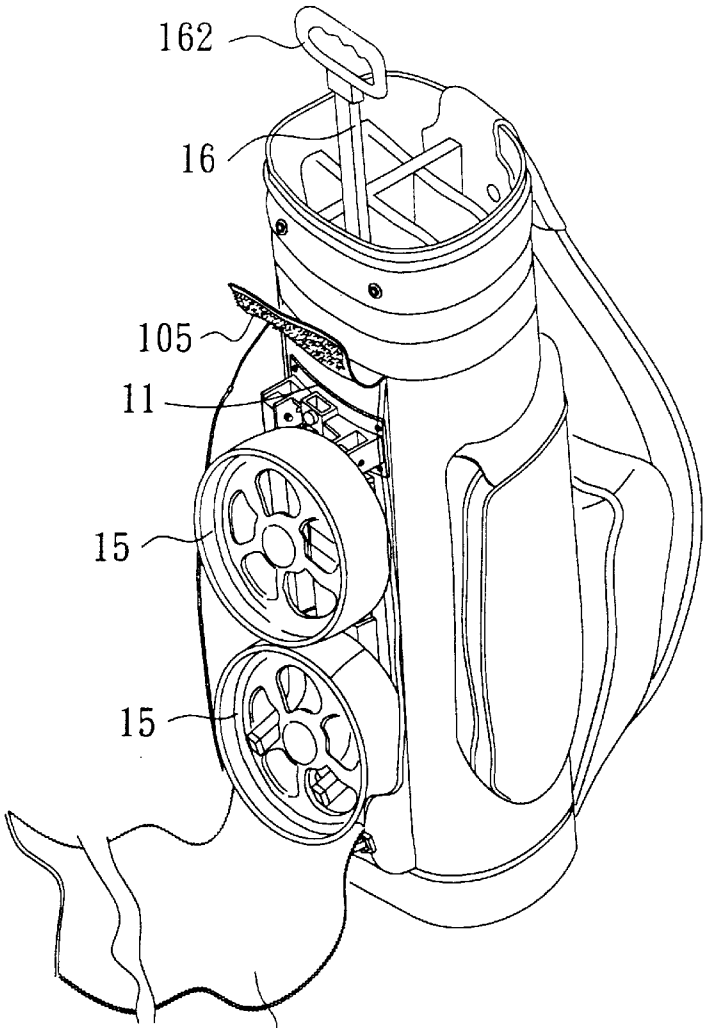
FIG. 6 is the second schematic drawing of the present invention in application state.
Figure 7:
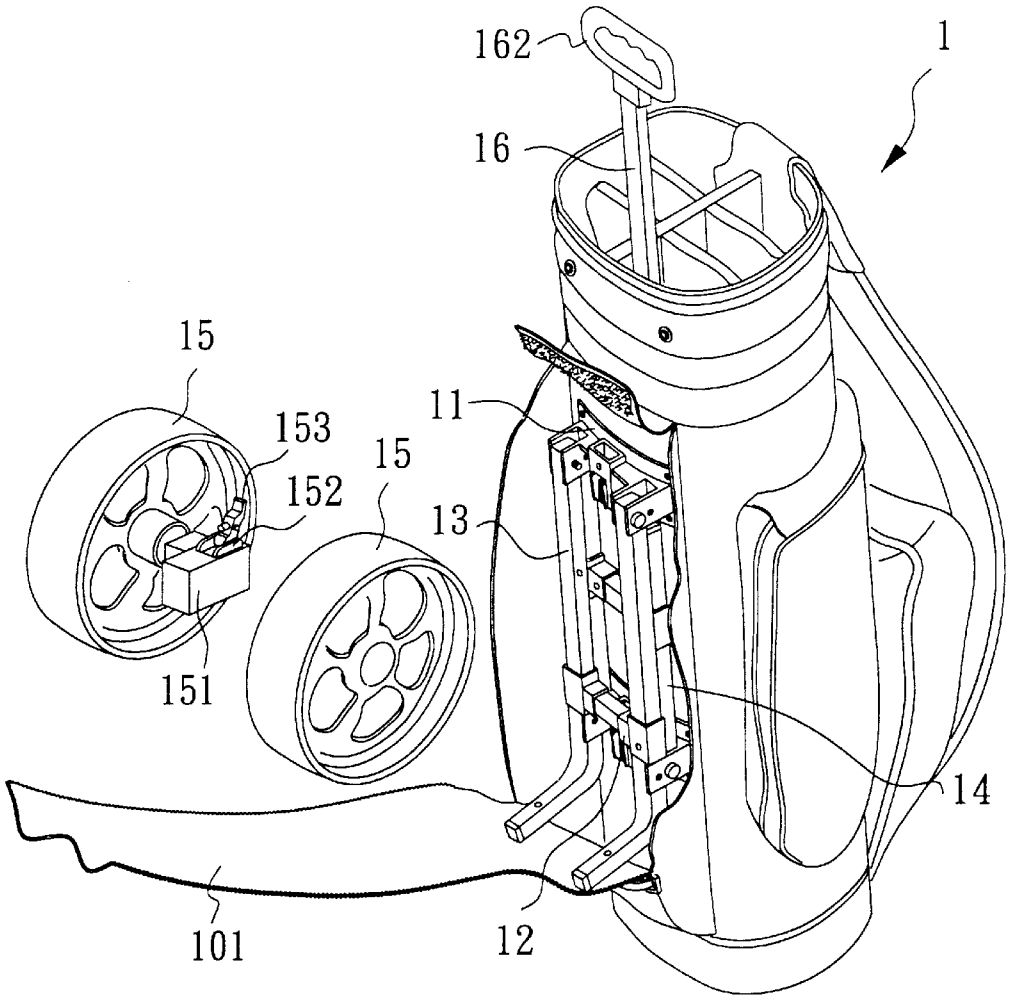
FIG. 7 is the third schematic drawing of the present invention in application state.

According to the present invention, referring to FIGS. 5, 6 and 7, an external cover fabric (101) is disposed outside the pocket body (10); a pair of zippers (102) is disposed respectively on two side rims connecting the pocket body (10) and the external cover fabric (101); the ends of the zippers (102) are connected by means of a pull string (103); to pull the pull string (103) connecting the zippers (102) on two side rims, simultaneously unzips or zips the zippers (102) on two side rims; simultaneously pulling the pull string (103) on two side rims downward to the bottom, rolls the external cover fabric (101) downward to the bottom of the pocket body (10) for storage; an upper cover fabric (104) is disposed in the upper aspect of the pocket body (10); a hook and loop strap is disposed at the connecting area between the upper cover fabric (104) and the external cover fabric (101) to allow the upper cover fabric (104) to cover over the external cover fabric (101).

According to the present invention, the primary and secondary supports (13, 14), the upper and lower pivot joint elements (11, 12), the engagement elements (17), the wheels (15) and the pull rod (16) can all be placed in the pocket body (10) without increasing the volume of the golf bag (1) to preserve the same external appearance of the traditional golf bag; the primary and the secondary supports (13, 14) are made of aluminum tubes (or even lighter material); the upper and the lower pivot joint elements (11, 12) as well as the said engagement elements (17) are made of plastics (or even lighter material); all the materials are lightweight, therefore, they won't add too much weight to the golf bag (1).

By virtue of assembly of the mentioned members, referring to FIGS. 2, 5, 6 and 7, when assembling the golf bag (1), the pull string (103) is pulled first to simultaneously unzip the said zippers (102) and open the external cover fabric (101) to be rolled into the lower aspect of the pocket body (10); then the wheels (15) are removed and the primary and secondary supports (13, 14) are sequentially opened outward to make the distal free ends of the primary support (13) superpose downwardly on the distal free ends of the secondary support (14); thereby, the wheels (15) can be assembled to the primary and secondary supports (13, 14); after that, the pull rod (16) is taken out of the pocket body (10) and is inserted into the engagement elements (17) of the upper and the lower pivot elements (11, 12); a pair of fix buttons (171) on one side of the engagement elements (17) retain into the insert holes (161) disposed on the pull rod (16), thereby the pull rod (16) is pulled to make the golf bag (1) move forward; when not moving, the wheels (15) and the golf bag (2) stand on one plane and function as a foot stand; when disassembly, the sequential order is reverse to that of the mentioned assembling order.

What is claimed is:

1. A golf bag functioning as a golf cart and a foot stand comprises:

a golf bag including a pocket body disposed on one lateral side of the golf bag; upper and lower pivot joint elements mounted on the golf bag within the pocket body; an external cover fabric on an outside the pocket body with a pair of zippers connecting the pocket body and the external cover fabric, ends of the zipper being connected by means of a pull string; an upper cover fabric disposed in an upper portion of the pocket body with a hook and loop fastener connecting the upper cover fabric and the external cover fabric;

a pair of secondary supports pivotally mounted on the lower pivot joint element;

a pair of primary supports pivotally mounted on the upper pivot joint element distal free ends of the primary supports bent to a predetermined angle to enable the distal free ends of the primary support to downwardly superpose distal free ends of the secondary support when the primary and the secondary supports are pulled outward; spaced insert holes disposed on top and bottom of the distal free ends of the primary and the secondary supports; a pair of wheels removably mounted on the distal free ends of the primary and the secondary supports by retaining elements releasably disposed on the distal free ends of the primary and the secondary supports, the retaining elements each having an opening enabling the distal free ends of the primary and the secondary supports to engage the retaining elements; open slots in upper and lower sides of the retaining elements corresponding to positions of the insert holes; a pair of flanges extending from the retaining elements on two sides of the open slots; a retainer pivotally disposed on each retaining element between the associated flanges and having a post fitting into one of the insert holes such that, when the distal free ends of the primary and the secondary supports and inserted in the retaining elements, the posts on the retainers of the retaining elements engage the insert holes of the primary and the secondary supports thereby removably connecting the wheels as well as the primary and the secondary supports together; a retaining slot disposed on inner sides of each of the flanges; convex bodies disposed on two sides of the retainer such that, when the posts on the retainers engage the insert holes of the primary and the secondary supports, the convex bodies simultaneously engage the retaining slots to make the retainers more firmly retain the primary and the secondary supports;

a pull rod removably mounted on the upper and lower pivot joint elements the pull rod sequentially passing through a pair of hollow engagement elements disposed on center areas of the upper and the lower pivot joint elements wherein, an opening is formed respectively on top and bottom sides of the engagement element on the upper pivot joint element and an opening is formed on a top side of the engagement element of the lower pivot joint element enabling the pull rod to be inserted into the engagement elements; a fix button mounted on one side of at least one of the engagement elements having an extending post facing a through hole on the associated engagement element such that, when the pull rod is inserted into the engagement element, the post on the fix button of the engagement element penetrates the through hole of the associated engagement element and engages an insert hole in the pull rod, thereby connecting the pull rod and the golf bag with each other; and adjacent to a center area the pull rod is bent outward to keep an upper end of the pull rod away from golf clubs inside the golf bag.

2. The golf bag functioning as a golf cart and a foot stand according to claim 1, further comprising a bolt extending outwardly from the retaining element at a joint area between the retaining element and the wheel bolt penetrating a through hole in a center of the wheel and engaged with a nut to pivotally connect the retaining element and the wheel.

3. The golf bag functioning as a golf cart and a foot stand according to claim 1, wherein: the pocket body is configured to receive the primary and secondary supports, the upper and lower pivot joint elements, the engagement elements; the primary and the secondary supports are made of aluminum tubes; and the pivot joint elements and the engagement elements are made of plastic.

* * * * *